US011541365B2

(12) United States Patent
Fang et al.

(10) Patent No.: US 11,541,365 B2
(45) Date of Patent: Jan. 3, 2023

(54) SLURRY MIXING DEVICE

(71) Applicant: ZHEJIANG CANAAN TECHNOLOGY LIMITED, Wenzhou (CN)

(72) Inventors: Zheng Fang, Wenzhou (CN); Jianying Chen, Wenzhou (CN); Wutong Wu, Wenzhou (CN); Zizheng Weng, Wenzhou (CN); Jianghai Liu, Wenzhou (CN); Li Shi, Wenzhou (CN)

(73) Assignee: ZHEJIANG CANAAN TECHNOLOGY LIMITED, Wenzhou (CN)

( * ) Notice: Subject to any disclaimer, the term of this patent is extended or adjusted under 35 U.S.C. 154(b) by 256 days.

(21) Appl. No.: 16/975,146

(22) PCT Filed: Jan. 10, 2020

(86) PCT No.: PCT/CN2020/071434
§ 371 (c)(1),
(2) Date: Aug. 24, 2020

(87) PCT Pub. No.: WO2020/199716
PCT Pub. Date: Oct. 8, 2020

(65) Prior Publication Data

US 2021/0245123 A1 Aug. 12, 2021

(30) Foreign Application Priority Data

Apr. 2, 2019 (CN) ..... 201910260545.9

(51) Int. Cl.
*B22C 5/00* (2006.01)
*B01F 35/92* (2022.01)
(Continued)

(52) U.S. Cl.
CPC ..... *B01F 35/92* (2022.01); *B01F 23/53* (2022.01); *B01F 27/90* (2022.01); *B01F 27/922* (2022.01);
(Continued)

(58) Field of Classification Search
CPC ..... B01F 35/71805; B01F 2035/98; B01F 35/21112; B01F 27/90
See application file for complete search history.

(56) References Cited

FOREIGN PATENT DOCUMENTS

CN 201867358 U 6/2011
CN 204811778 U 12/2015
(Continued)

OTHER PUBLICATIONS

Google machine translation for "CN-107321227-A" (Year: 2017).*
Google machine translation for "CN-107824152-A" (Year: 2018).*

*Primary Examiner* — Anshu Bhatia
*Assistant Examiner* — Gregory Y Huan
(74) *Attorney, Agent, or Firm* — Bayramoglu Law Offices LLC

(57) ABSTRACT

A slurry mixing device includes an installation frame, a slurry mixing tank, a slurry feeding tank, a cooling mechanism and a slurry discharging mechanism. The slurry feeding tank is movably arranged under the slurry mixing tank, the cooling mechanism and the slurry discharging mechanism. A mass scale is arranged under the slurry feeding tank. A stirring cavity is formed in the slurry mixing tank, and a stirring paddle is arranged in the stirring cavity. A stirring motor is arranged on the slurry mixing tank. An outlet is arranged on the bottom of the stirring cavity. An oil bath cavity is formed between the slurry mixing tank and the stirring cavity. The cooling mechanism includes a lifting cylinder and a lifting base. The lifting base is provided with
(Continued)

a rotating paddle and a rotating motor. The lifting cylinder is arranged on the installation frame.

14 Claims, 6 Drawing Sheets

(51) Int. Cl.

| | |
|---|---|
| ***B01F 23/53*** | (2022.01) |
| ***B01F 27/90*** | (2022.01) |
| ***B01F 27/922*** | (2022.01) |
| ***B01F 35/21*** | (2022.01) |
| ***B01F 35/32*** | (2022.01) |
| ***B01F 35/71*** | (2022.01) |
| ***B01F 35/75*** | (2022.01) |
| *B01F 23/50* | (2022.01) |
| *B01F 35/90* | (2022.01) |

(52) U.S. Cl.
CPC ..... *B01F 35/2115* (2022.01); *B01F 35/2117* (2022.01); *B01F 35/21112* (2022.01); *B01F 35/3204* (2022.01); *B01F 35/71805* (2022.01); *B01F 35/75425* (2022.01); *B01F 23/565* (2022.01); *B01F 2035/98* (2022.01); *B01F 2035/99* (2022.01)

(56) References Cited

FOREIGN PATENT DOCUMENTS

| | | | | | |
|---|---|---|---|---|---|
| CN | 107321227 | A | * | 11/2017 | ..... B01F 15/0254 |
| CN | 107824152 | A | * | 3/2018 | |
| CN | 108260785 | A | * | 7/2018 | ..... A23L 19/10 |
| CN | 108654451 | A | | 10/2018 | |
| CN | 108970521 | A | | 12/2018 | |
| CN | 109206527 | A | | 1/2019 | |
| CN | 110193320 | A | | 9/2019 | |

* cited by examiner

SLURRY MIXING DEVICE

CROSS REFERENCE TO THE RELATED APPLICATIONS

This application is the national phase entry of International Application No. PCT/CN2020/071434, filed on Jan. 10, 2020, which is based upon and claims priority to Chinese Patent Application No. 201910260545.9, filed on Apr. 2, 2019, the entire contents of which are incorporated herein by reference.

TECHNICAL FIELD

The present invention relates to the technical field of slurry mixing equipment, in particular to a slurry mixing device.

BACKGROUND

At present, in pharmaceutical and food production, it is frequently necessary to mix powders. When powder is mixed to form a slurry with relatively high consistency, the stirring efficiency of existing slurry mixing tanks is relatively low in the process of gelatinization and maturation, which leads to the coking of the slurry at the edge position. Moreover, existing slurry mixing tanks are usually heated by means of a water bath. Since the heating temperature of the water bath is insufficient, slurry mixtures having a large-volume of powder cannot be fully heated when mixed, which causes low mixing efficiency and is not applicable to processing slurries having large volumes. Additionally, it is difficult to check the position of the heating liquid in existing slurry mixing tanks, making it difficult for the operator to timely replenish the heating liquid or to add the heating liquid to an exact place, thereby further reducing efficiency. After the completion of slurry mixing, the mixed slurry is added to the slurry feeding tank, and then transported and cooled through the slurry feeding tank. Finally, the slurry in the slurry feeding tank is discharged and then processed and utilized later. Slurries with high consistencies are likely to adhere to the side wall of the tank, and are difficult to completely discharge, resulting in a waste of resources. The existing slurry discharge structure is inefficient, reducing the efficiency of the equipment.

SUMMARY

In view of the disadvantages of the prior art, the present invention provides a slurry mixing device, which has a simple structure and a good slurry mixing effect. The slurry mixing device also has the functions of transporting, cooling, extruding and discharging the slurry, so as to improve the production and processing efficiency.

The present invention provides a slurry mixing device, including an installation frame, a slurry mixing tank, a slurry feeding tank, a cooling mechanism and a slurry discharging mechanism. The slurry mixing tank, the cooling mechanism and the slurry discharging mechanism are successively arranged on the installation frame. The installation frame is provided with a transport channel under the slurry mixing tank, the cooling mechanism and the slurry discharging mechanism. The slurry feeding tank is provided with an open end and is movably arranged in the transport channel along the direction of the transport channel. The transport channel is provided with a mass scale at the position corresponding to the slurry mixing tank. A stirring cavity is formed in the slurry mixing tank, and a stirring paddle is rotatably arranged in the stirring cavity. A stirring motor for rotatably driving the stirring paddle is arranged on the slurry mixing tank. The bottom of the stirring cavity extends to the outside of the slurry mixing tank to form an outlet. An oil bath cavity is formed between the slurry mixing tank and the stirring cavity. The cooling mechanism includes a lifting cylinder and a lifting base. The lifting base is provided with a rotating paddle and a rotating motor for rotatably driving the rotating paddle. The lifting cylinder is arranged on the installation frame. The output end of the lifting cylinder is arranged along the height direction of the installation frame, and the output end of the lifting cylinder is connected to the lifting base to cause the rotating paddle to enter the slurry feeding tank and to perform a cooling operation. The slurry discharging mechanism includes a piston and a driving cylinder configured to drive the piston to enter the slurry feeding tank to extrude and discharge a slurry. The output end of the driving cylinder is arranged along the height direction of the installation frame, and the piston is connected to the output end of the driving cylinder. The piston is provided circumferentially with an elastic sealing ring for an interference fit with the slurry feeding tank after the piston enters the slurry feeding tank. A slurry outlet is arranged at the bottom of the slurry feeding tank.

The advantages of this arrangement are as follows: the starch slurry is heated in the oil bath and continuously stirred until gelatinization and maturation. During the mixing process, the stirring motor is always turned on, so that the starch is stirred and rolled continuously to fully dissolve and suspend. An electric heating pipe is arranged in the oil bath cavity to make the temperature of the oil rise rapidly. When the temperature of the starch slurry reaches 75° C., the starch slurry begins to gelatinize and mature. After the work of mixing the slurry is completed, and the heat conduction oil can be kept in a heat preservation state. The bottom of the slurry mixing tank is provided with the outlet, and the outlet is connected to a quick loading pneumatic butterfly valve, which can fully meet requirements of the slurry discharge speed and the consistency of the starch slurry. The slurry is discharged from the outlet into the slurry feeding tank arranged at the bottom. The slurry feeding tank is placed on the mass scale, and the mass scale accurately reads the mass of the slurry. The pneumatic butterfly valve can be controlled by the system to be closed when the slurry is fed until the set weight is obtained. After the slurry enters the slurry feeding tank, the next step proceeds. This structure is simple and can quickly mix the slurry and has a good mixing effect for the slurry with high consistency. This structure has a good heating effect and a fast heating speed and improves the efficiency of the equipment. The slurry feeding tank passes the cooling mechanism and the slurry discharge mechanism in turn. The slurry in the slurry feeding tank is stirred and cooled in the cooling mechanism to form a uniform cooled starch slurry. When the slurry moves to the slurry discharge mechanism, the piston is driven by the driving cylinder to enter the slurry feeding tank, and then the elastic sealing ring on the outer peripheral wall of the piston abuts on the inner wall of the slurry feeding tank to form an interference fit between the piston and the slurry feeding tank, so that the piston can continue to go deep into the slurry feeding tank to extrude out the slurry in the slurry feeding tank, which has a better slurry discharging ability to discharge the slurry fully, efficiently and quickly.

Further, an electric heating pipe is arranged in the oil bath cavity. An oil outlet is arranged on the bottom surface of the oil bath cavity, and an oil inlet is arranged on the side wall of the slurry mixing tank. The oil inlet is connected to the oil bath cavity, and the oil inlet is provided with an oil feeding mechanism for transporting oil into the oil bath cavity. An inspection window is arranged on the side wall of the slurry mixing tank. The inspection window is arranged under the oil feeding mechanism and is connected to the oil bath cavity. The inspection window is provided with an oil level sight glass.

The advantages of this arrangement are as follows: in the above solution, the oil level sight glass is configured to observe the oil level, which facilitates in timely replenishing the oil or to stop feeding the oil, rapidly transports the slurry and improves production and processing efficiency.

Further, the oil feeding mechanism includes a T-shaped three-way pipe, and the T-shaped three-way pipe includes a main pipe, a first pipe and a second pipe, wherein the first pipe and the second pipe are arranged on both sides of the main pipe. The main pipe is connected to the oil inlet. One end of the first pipe and the main pipe communicate, and the other end of the first pipe is connected to an oil feeding funnel. One end of the second pipe is connected to the main pipe, and the other end of the second pipe is connected to a smoke exhaust assembly. The main pipe is provided with a three-way ball valve configured to be connected to the first pipe or the second pipe.

The advantages of this setting are as follows: in the above solution, the oil feeding mechanism arranged in this way has a simple structure and is easy to disassemble and assemble. When the oil of the oil bath cavity needs to replenished, the oil feeding mechanism is started by the three-way ball valve to be connected to the first pipe, so that the oil enters the oil bath cavity. During the process of oil bath, the first pipe is closed, and the oil feeding mechanism is switched to be connected to the second pipe. Then, the oil feeding mechanism is connected to the smoke exhaust assembly, so that the smoke is exhausted. The present invention has a multifunctional simply compact structure.

Further, the smoke exhaust assembly includes a respirator and an oil collecting bottle. The upper end of the respirator is provided with a smoke outlet, and the lower end of the respirator is provided with a connection port connected to the second pipe. An oil filter core is arranged between the smoke outlet and the connection port. The oil collecting bottle is arranged on one side of the connection port, and the oil collecting bottle is connected to the respirator through a conduit.

The advantages of this setting are as follows: in the above solution, the smoke exhaust assembly has a simple structure capable of collecting the filtered oil, which improves the efficiency of the whole equipment.

Further, a hose is arranged between the second pipe and the three-way ball valve. A clamping head is arranged on the outer wall of the second pipe. The clamping head includes a rotating base and a plurality of rotating arms. The rotating base is threaded to the outer wall of the second pipe. One end oFf the rotating arm is hinged on the rotating base, and the other end of the rotating arm is a free end. The free end of the rotating arm abuts on the outer wall of the hose to press the hose. The inner wall of the hose is provided with a reset bracket for resetting the hose after the hose is pressed. The connection position of the three-way ball valve and the second pipe is provided with a positioning groove, and the free end of the rotating arm is inserted into the positioning groove to fix the clamping head.

The advantages of this arrangement are as follows: in the above solution, the oil is accumulated in the pipe, especially, the oil easily accumulates in the hose, resulting in an obstruction of the pipe. In this case, the free end of the rotating arm can be pressed to abut on the outer wall of the hose, and the rotating base is rotated to drive the rotating arm to extrude the oil clogged in the pipe, so as converge the oil at any end of the hose. And then the hose is pulled out to drain the overflowed oil, so as to solve the problem of obstruction of the pipe. This structure is simple and convenient for operation, and prevents the poor exhaust effect as a result of oil obstructed in the pipe, which improves the efficiency of the whole structure. The reset bracket is configured to reset the deformed hose, which improves the strength of the hose and avoids the obstruction of the pipe as a result of hose deformation. The free end of the rotating arm can be limited by the positioning groove to prevent the rotating arm from abutting on the hose. Furthermore, the rotating arm can protect the hose through the positioning groove, so as to prevent the hose from being damaged by external forces and improve the service life of the product.

Further, the stirring paddle includes a stirring shaft. One end of the stirring shaft is connected to the stirring motor, and the other end of the stirring shaft extends into the stirring cavity. Connecting rods are arranged at intervals along the height direction on the stirring shaft, and the projections of the connecting rods adjacent to each other on the bottom surface of the stirring cavity are perpendicular. The ends of the connecting rods adjacent to each other are connected to a blade, and the blades are connected to each other to form a double helical stirring blade.

The advantages of this arrangement are as follows: in the above solution, the stirring paddle having the above-mentioned structure can better stir the slurry with high consistency and improve the efficiency of the product.

Further, the slurry mixing tank is provided with a water inlet, and the water inlet is connected to the stirring cavity. A water inlet pipe is arranged on the water inlet, and a diaphragm valve and a flowmeter are arranged between the water inlet pipe and the water inlet in turn.

The advantages of this setting are as follows: in the above solution, it is convenient to control the water inflow, which improves the stirring effect.

Further, a jacket is formed on the outer wall of the slurry feeding tank, and a water injection cavity is formed in the jacket. The water inlet pipe is arranged on the jacket, and the water inlet pipe is connected to the water injection cavity. The bottom surface of the jacket is further provided with a water outlet pipe connected to the water injection cavity.

The advantages of this setting are as follows: in the above solution, it is convenient to cool the tank by adding the water into the water injection cavity. The structure is simple, which is easily constructed.

Further, a shielding cover is arranged between the piston and the output end of the driving cylinder. A locking groove is arranged on the edge of the shielding cover. A locking handle for fixing the shielding cover on the slurry feeding tank is hinged on the outer wall of the slurry feeding tank. The width of the locking handle is matched with the width of the locking groove. One end of the locking handle is hinged to the outer wall of the slurry feeding tank, and the other end of the locking handle is threaded to the positioning cap. The positioning cap is rotated to abut on the shielding cover, so as to make the shielding cover fixedly connected to the slurry feeding tank.

The advantages of this arrangement are as follows: in the above solution, the shielding cover is configured to prevent external impurities from entering in the slurry discharge process, thereby ensuring the cleanliness of the slurry. This structure is simple. Moreover, the locking handle arranged on the side wall of the slurry feeding tank can quickly lock and unlock the shielding cover, so as to improve the efficiency of the device.

Further, the rotating paddle includes a rotating shaft and at least two rotating blades connected to the rotating shaft. One end of the rotating shaft is connected to the output end of the rotating motor, and the other end of the rotating shaft is an extension end. The rotating blades are L-shape. The transverse end of the rotating blade is connected to the extension end of the rotating shaft. The rotating shaft is further provided with a temperature measurement probe for measuring temperature.

The advantages of this setting are as follows: in the above solution, the rotating blades are designed to be L-shaped to fully stir the slurry, which can improve the stirring efficiency and the cooling effect. Meanwhile, the temperature measurement probe can read the temperature measured in time and determine the degree of cooling.

DETAILED DESCRIPTION OF THE EMBODIMENTS

Figure 1:
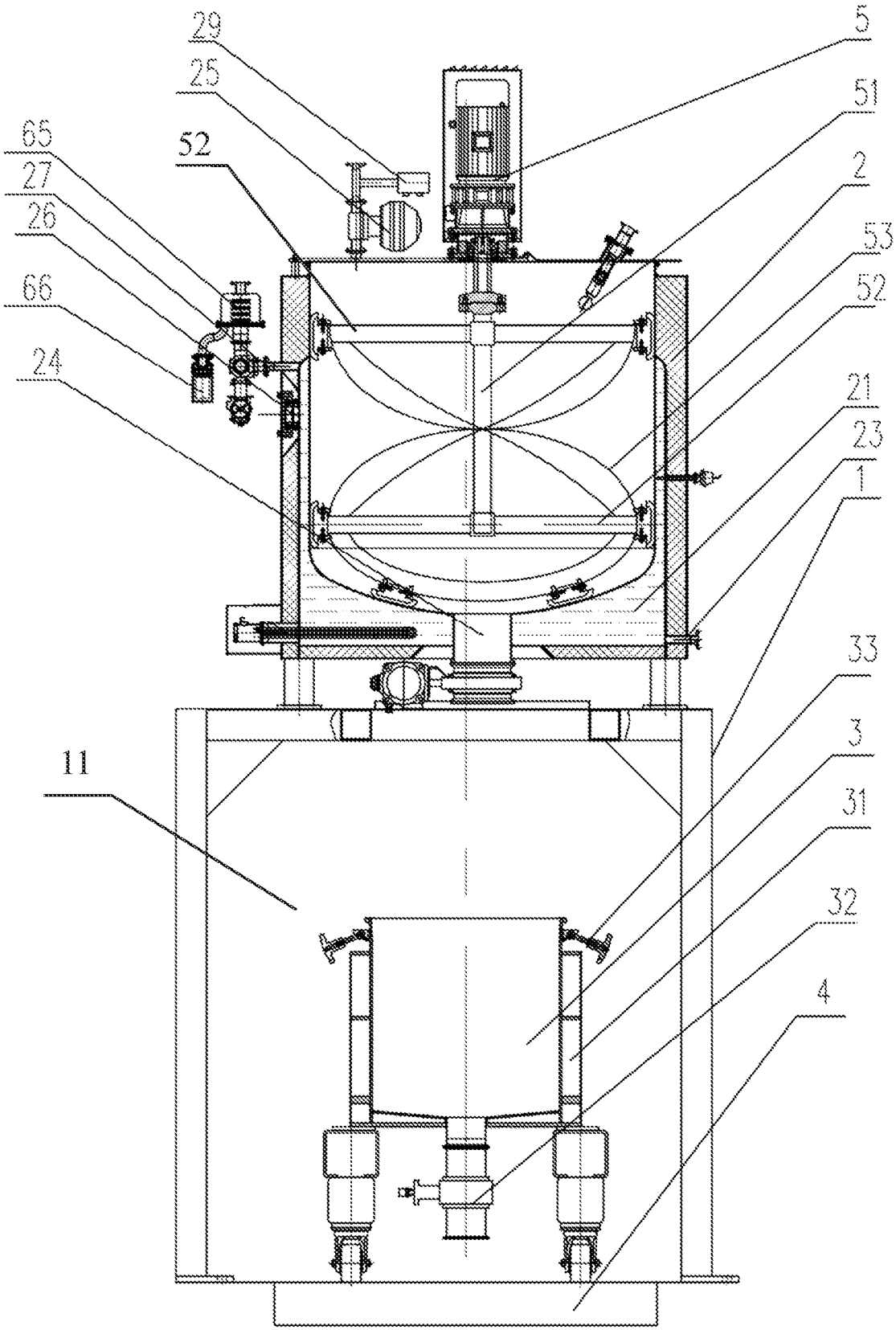
FIG. 1 is a sectional diagram of the slurry mixing tank in an embodiment of the present invention.
Figure 2:
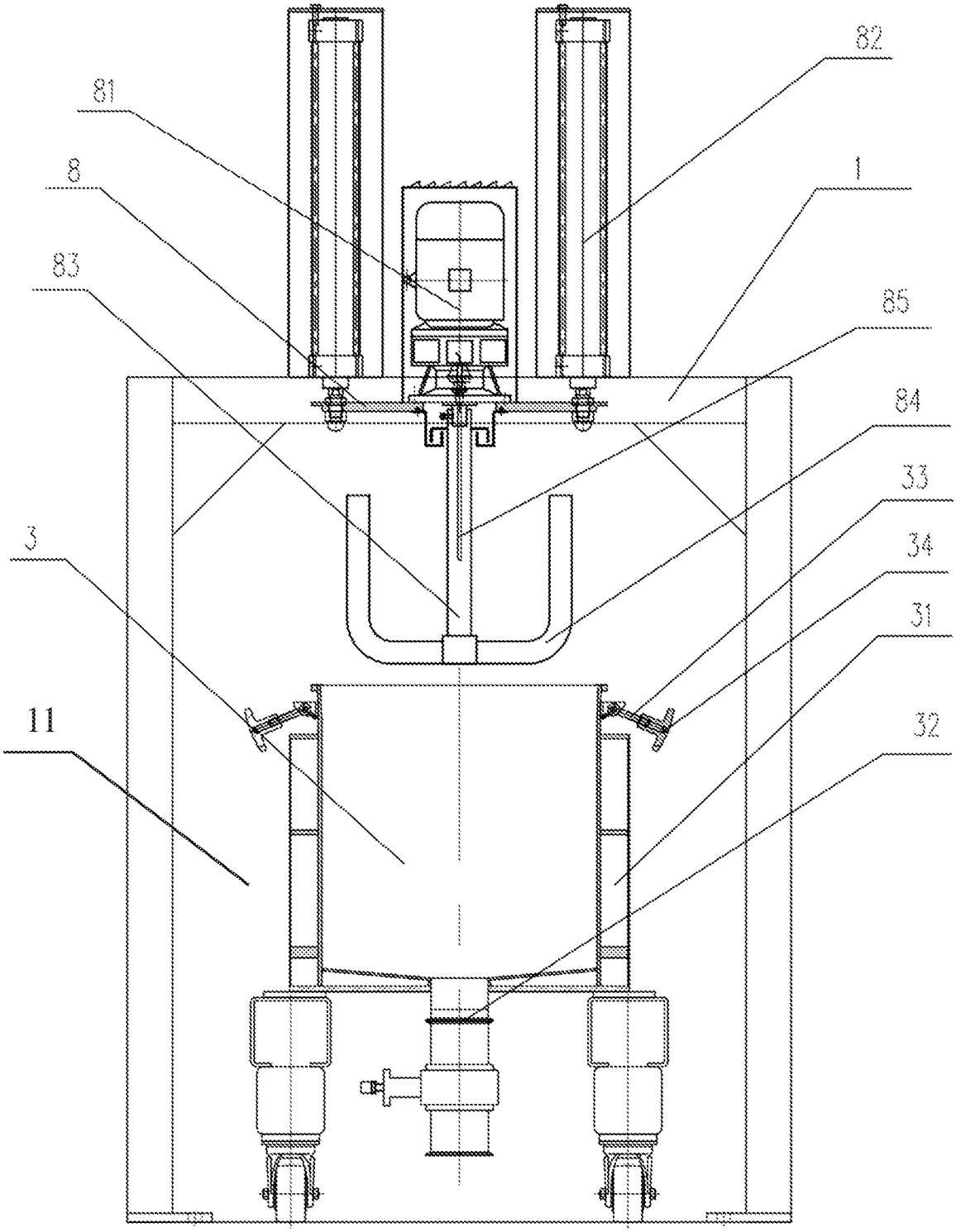
FIG. 2 is a sectional diagram of the structure of the cooling mechanism of an embodiment of the present invention.
Figure 3:
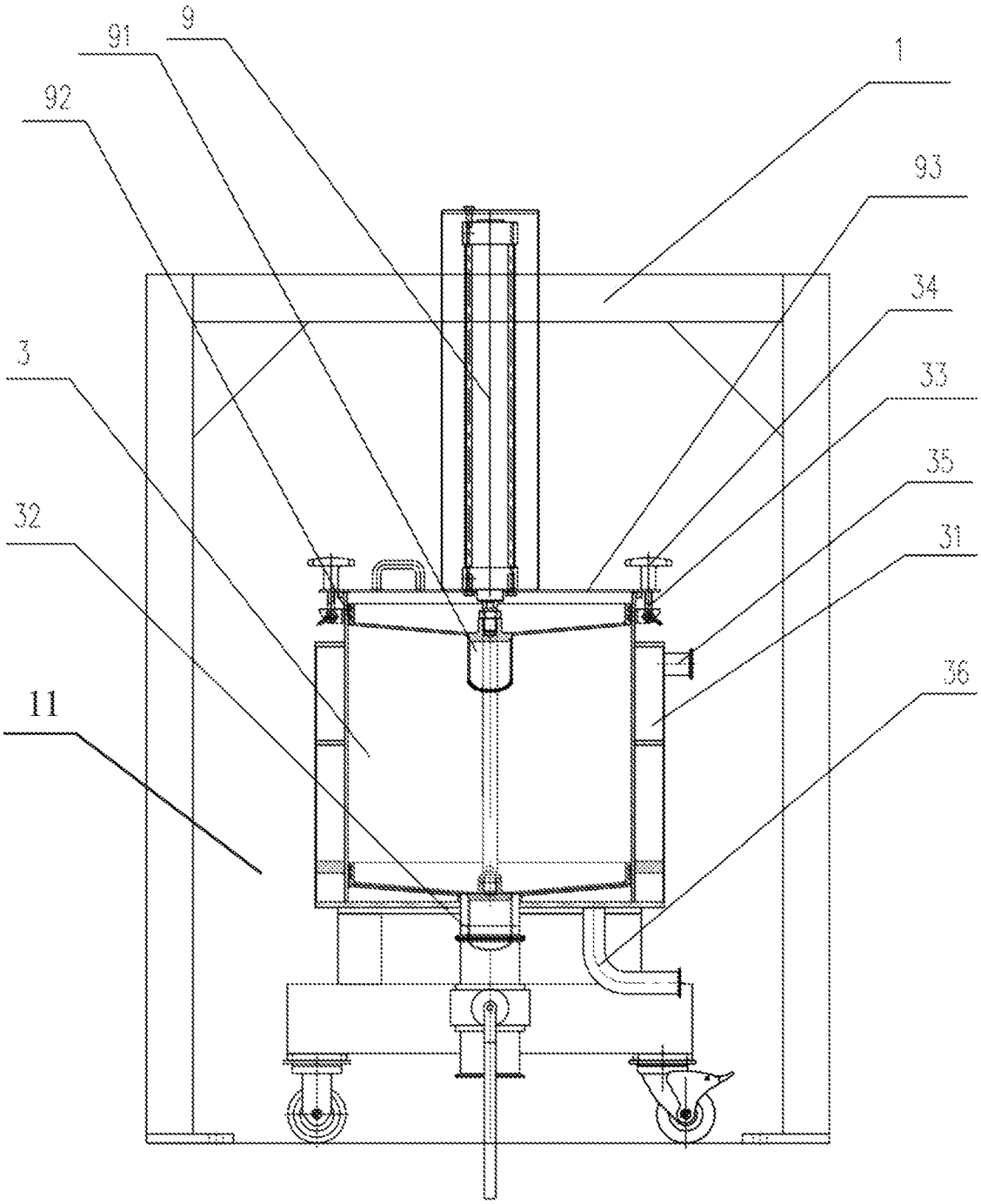
FIG. 3 is a sectional diagram of the structure of the slurry discharging mechanism of an embodiment of the present invention.

As shown in FIGS. 1 and 2, the slurry mixing device includes the installation frame 1, the slurry mixing tank 2, the slurry feeding tank 3, the cooling mechanism and the slurry discharging mechanism. The slurry mixing tank 2, the cooling mechanism and the slurry discharging mechanism are successively arranged on the installation frame 1. The installation frame 1 is provided with a transport channel 11 under the slurry mixing tank 2, the cooling mechanism and the slurry discharging mechanism. The slurry feeding tank 3 is provided with an open end and is movably arranged in the transport channel 11 along the direction of the transport channel 11. The transport channel 11 is provided with the mass scale 4 at the position corresponding to the slurry mixing tank 2. The stirring cavity is formed in the slurry mixing tank 2, and the stirring paddle is rotatably arranged in the stirring cavity. The stirring motor 5 for rotatably driving the stirring paddle is arranged on the slurry mixing tank 2. The bottom of the stirring cavity extends to the outside of the slurry mixing tank 2 to form the outlet 24. The oil bath cavity 21 is formed between the slurry mixing tank 2 and the stirring cavity. As shown in FIG. 2, the cooling mechanism includes the lifting cylinder 82 and the lifting base 8. The lifting base 8 is provided with the rotating paddle and the rotating motor 81 for rotatably driving the rotating paddle. The lifting cylinder 82 is arranged on the installation frame 1. The output end of the lifting cylinder 82 is arranged along the height direction of the installation frame 1, and the output end of the lifting cylinder 82 is connected to the lifting base 8 to cause the rotating paddle to enter the slurry feeding tank 3 and to perform the cooling operation. As shown in FIG. 3, the slurry discharging mechanism includes the piston 91 and the driving cylinder 9 configured to drive the piston 91 to enter the slurry feeding tank 3, so as to extrude and discharge the slurry. The output end of the driving cylinder 9 is arranged along the height direction of the installation frame 1, and the piston 91 is connected to the output end of the driving cylinder 9. The piston 91 is provided circumferentially with the elastic sealing ring 92 that forms an interference fit with the slurry feeding tank 3 after the piston 91 enters the slurry feeding tank 3. The slurry outlet 32 is arranged at the bottom of the slurry feeding tank 3. The advantages of this arrangement are as follows: in this way, the starch slurry is heated in the oil bath and continuously stirred to be gelatinized and matured. As shown in FIG. 1, during the mixing process, the stirring motor 5 is always turned on, so that the starch is stirred and rolled continuously to fully dissolve and suspend. An electric heating pipe is arranged in the oil bath cavity 21 to rise the temperature of the oil rapidly. When the temperature of the starch slurry reaches 75° C., the starch slurry begins to be gelatinized and matured. After the work of mixing the slurry is completed, the heat conduction oil is maintained in a heat preservation state. The bottom of the slurry mixing tank 2 is provided with the outlet 24, and the outlet 24 is connected to the quick loading pneumatic butterfly valve, which can fully meet the requirements of the slurry discharge speed and the viscosity of the starch slurry. The slurry is discharged from the outlet 24 into the slurry feeding tank 3 arranged at the bottom. The slurry feeding tank 3 is arranged on the mass scale 4, and the mass scale 4 can accurately read out the mass of the slurry. The pneumatic butterfly valve can be controlled by the system to be closed when the slurry is fed to the set weight. After the slurry enters the slurry feeding tank 3, the next step proceeds. This structure is simple and provides quick slurry mixing and has a good mixing effect for the slurry with high consistency. Besides, this structure has a good heating effect and a fast heating speed and improves the efficiency of the equipment. As shown in FIG. 3, the slurry passes the cooling mechanism and the slurry discharge mechanism in turn as follows. The slurry in the slurry feeding tank 3 is stirred and cooled in the cooling mechanism to form a uniformly cooled starch slurry. After the slurry moves to the slurry discharge mechanism, the piston 91 is driven by the driving cylinder 9 to enter the slurry feeding tank 3, and then the elastic sealing ring 92 on the outer peripheral wall of the piston 91 abuts on the inner wall of the slurry feeding tank 3 to form an interference fit between the piston 91 and the slurry feeding tank 3, so that the piston 91 can continue to go deep into the slurry feeding tank 3 to extrude out the slurry in the slurry feeding tank 3, which has a better slurry discharging ability to discharge the slurry fully, efficiently and quickly.

As shown in FIG. 1, the electric heating pipe is arranged in the oil bath cavity 21. The oil outlet 23 is arranged on the bottom surface of the oil bath cavity 21, and the oil inlet 27 is arranged on the side wall of the slurry mixing tank 2. The oil inlet 27 is connected to the oil bath cavity 21. The oil inlet 27 is provided with the oil feeding mechanism used for transporting oil into the oil bath cavity 21. The inspection window 26 is further arranged on the side wall of the slurry mixing tank 2. The inspection window 26 is arranged under the oil feeding mechanism and is connected to the oil bath cavity 21. The inspection window 26 is provided with the oil level sight glass. The advantages of this arrangement are as follows: in the above solution, the oil level sight glass is configured to allow observation of the oil level, which contributes to timely replenishing of the oil or stopping feeding of the oil, realizes the rapid slurry transportation operation and improves the production and processing efficiency.

Figure 4:
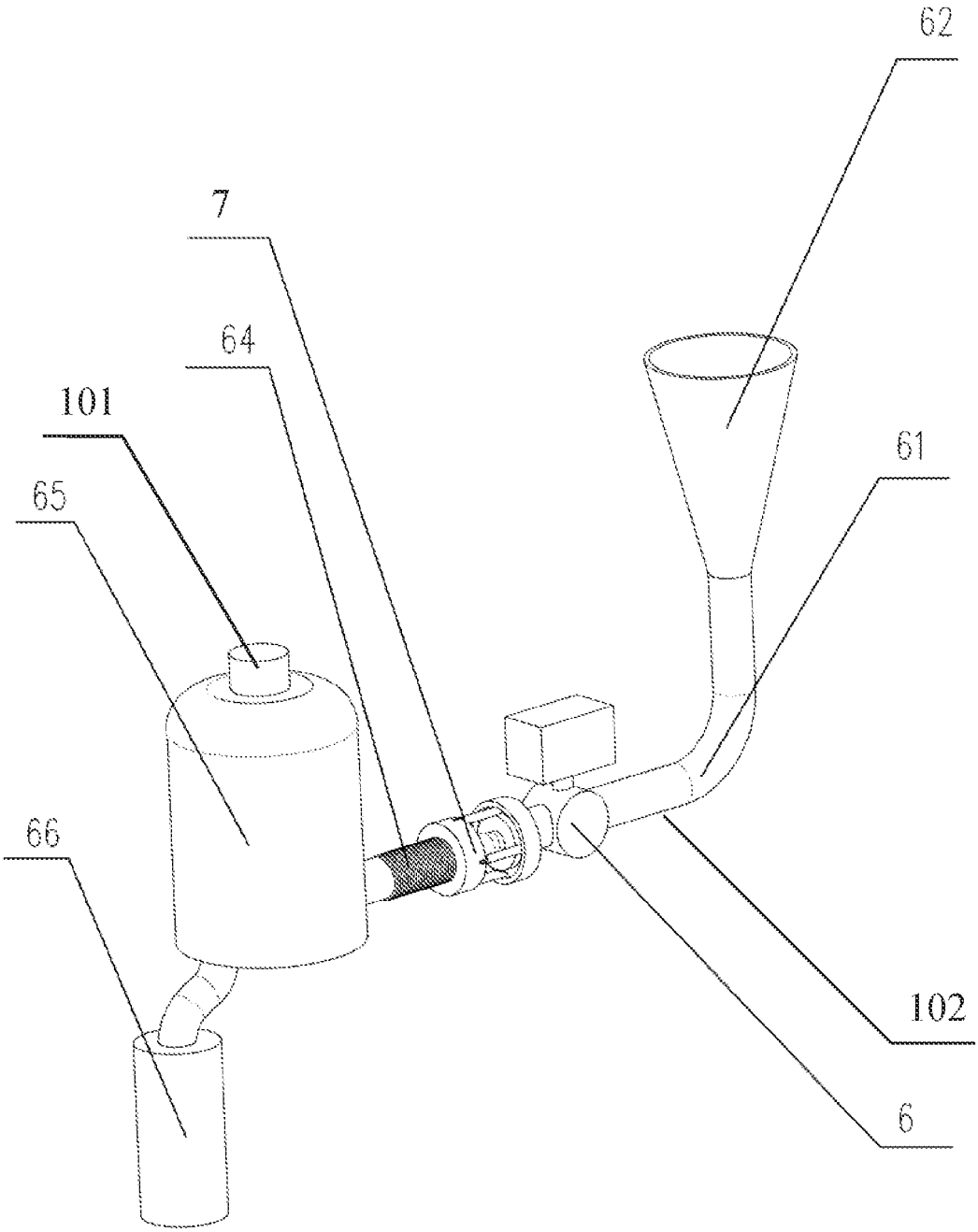
FIG. 4 is a schematic diagram of the structure of the three-way pipe in an embodiment of the present invention.

As shown in FIG. 4, the oil feeding mechanism includes the T-shaped three-way pipe, and the T-shaped three-way pipe includes the main pipe 102, the first pipe 61 and the second pipe 64, wherein the first pipe 61 and the second pipe 64 are arranged on both sides of the main pipe 102. The main pipe 102 is connected to the oil inlet 27. One end of the first pipe 61 is connected to the main pipe 102, and the other end of the first pipe 61 is connected to the oil feeding funnel 62. One end of the second pipe 64 is connected to the main pipe 102, and the other end of the second pipe 64 is connected to the smoke exhaust assembly. The main pipe 102 is provided with the three-way ball valve 6 connected to the first pipe 61 or the second pipe 64. The advantages of this arrangement are as follows: in the above solution, the oil feeding mechanism arranged in this form has a simple structure and is easy to disassemble and assemble. When the oil of the oil bath cavity 21 needs to be replenished, the oil feeding mechanism is started by the three-way ball valve 6 to be connected to the first pipe 61, so that the oil enters the oil bath cavity 21. During the process of filling the oil bath, the first pipe 61 is closed, and the oil feeding mechanism is switched to be connected to the second pipe 64. Then, the oil feeding mechanism is connected to the smoke exhaust assembly, so that the smoke is exhausted. This structure has a variety of functions, and is compact and easily constructed.

The smoke exhaust assembly includes the respirator 65 and the oil collecting bottle 66. The upper end of the respirator 65 is provided with the smoke outlet 101, and the lower end of the respirator 65 is provided with the connection port and connected to the second pipe 64. The oil filter core is arranged between the smoke outlet 101 and the connection port. The oil collecting bottle 66 is arranged on one side of the connection port, and the oil collecting bottle 66 is connected to the respirator 65 through the conduit. The advantages of this setting are as follows: in the above solution, the smoke exhaust assembly has a simple structure capable of collecting the filtered oil, which improves the efficiency of the whole equipment.

Figure 5:
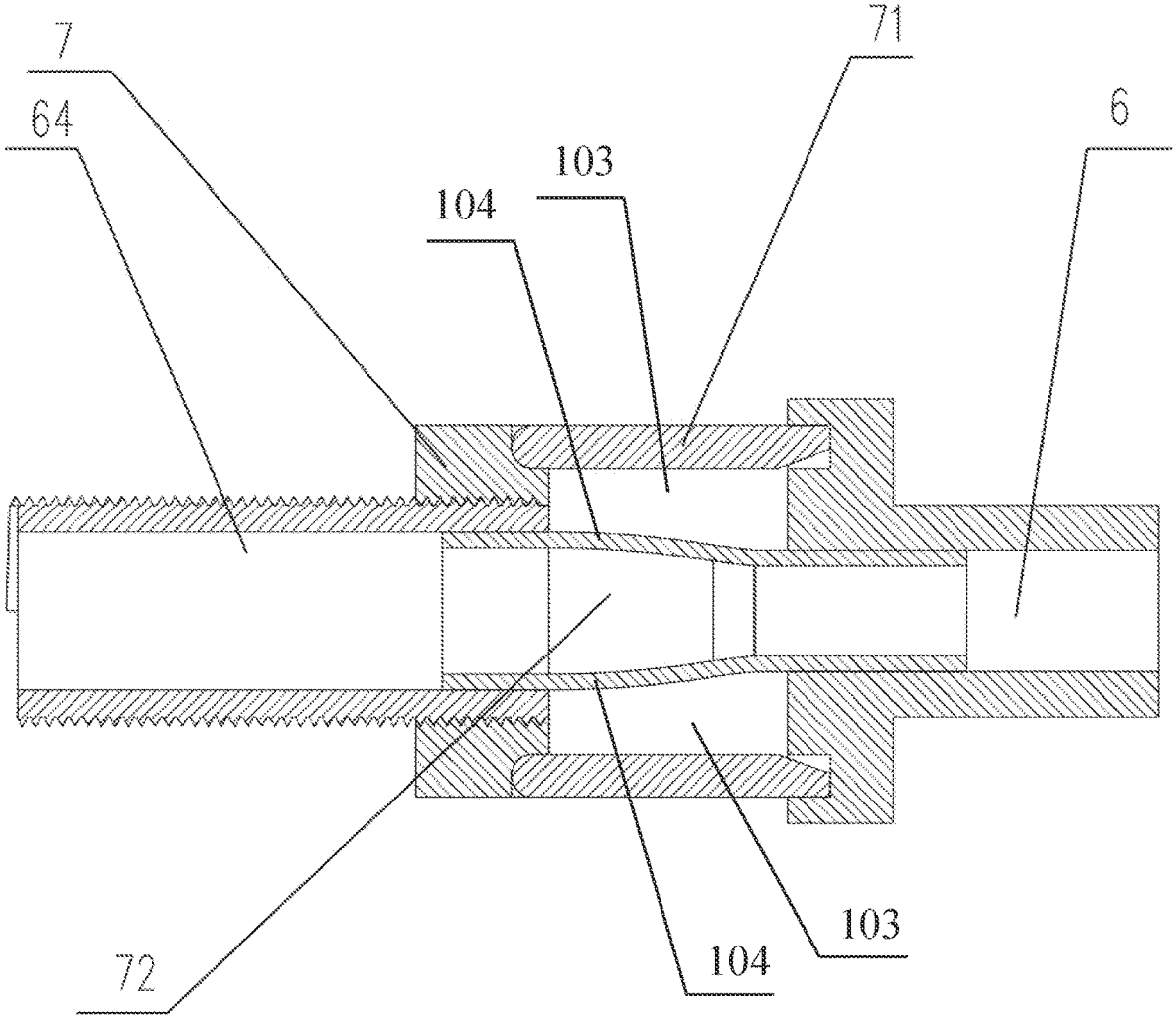
FIG. 5 is a sectional diagram showing the clamping head protecting the hose in an embodiment of the present invention.
Figure 6:
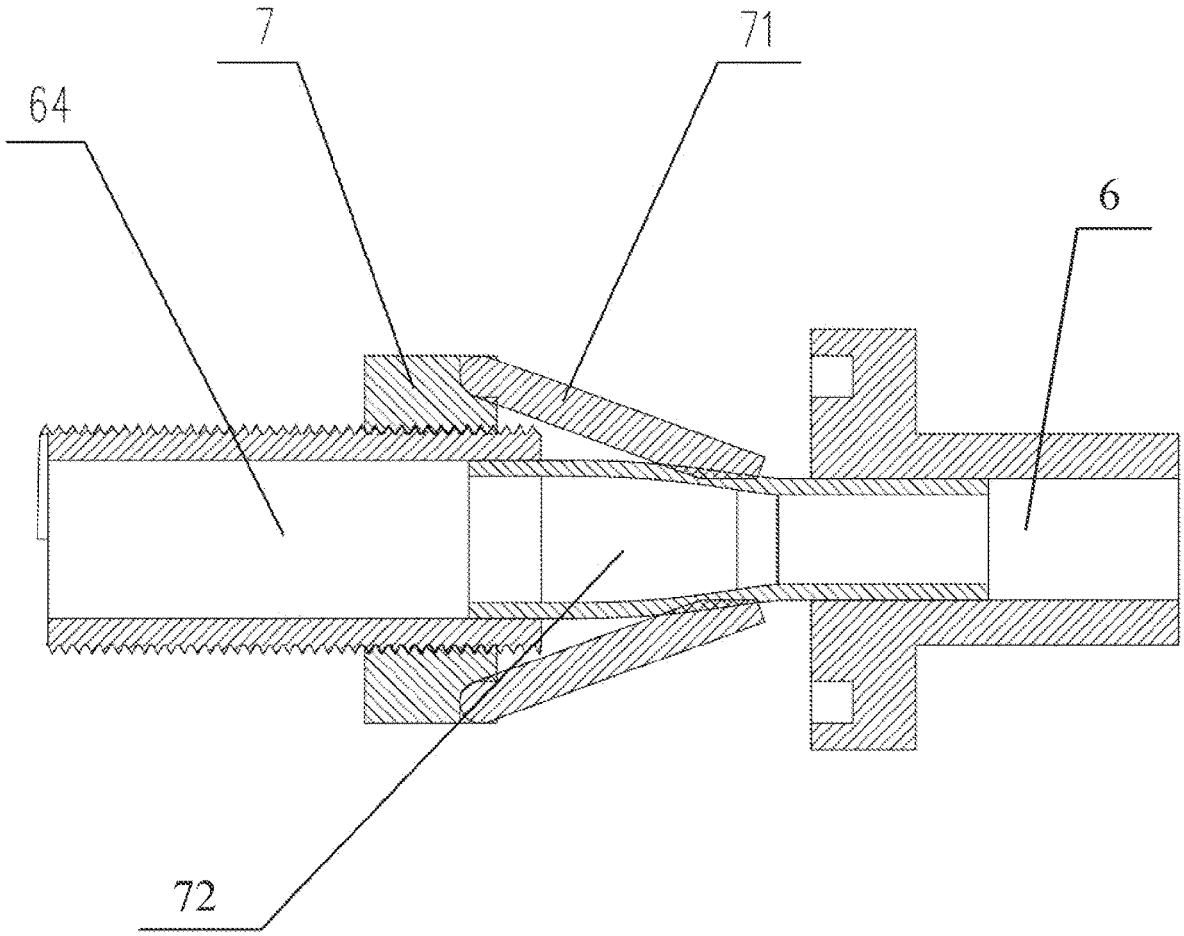
FIG. 6 is a sectional diagram showing the clamping head pressing the hose in an embodiment of the present invention.

As shown in FIGS. 5 and 6, the hose 72 is arranged between the second pipe 64 and the three-way ball valve 6. The clamping head is arranged on the outer wall of the second pipe 64. The clamping head includes the rotating base 7 and a plurality of rotating arms 71. The rotating base 7 is threaded to the outer wall of the second pipe 64. One end of the rotating arm 71 is hinged on the rotating base 7, and the other end of the rotating arm 71 is a free end. The free end of the rotating arm 71 abuts on the outer wall of the hose 72 to press the hose 72. The inner wall of the hose 72 is provided with the reset bracket 104 which is used for resetting the hose 72 after the hose 72 is pressed. The positioning groove 103 is provided at the connection position of the three-way ball valve 6 and the second pipe 64, and the free end of the rotating arm 71 is inserted into the positioning groove 103 to make the clamping head fixed. The advantages of this arrangement are as follows: in the above solution, when the oil is accumulated in the pipe, the oil is likely to accumulate at the position of the hose 72, resulting in an obstruction of the pipe. In this case, the free end of the rotating arm 71 can be pressed to abut on the outer wall of the hose 72, and the rotating base 7 is rotated to drive the rotating arm 71 to extrude the oil clogged in the pipe, so as to converge the oil at any end of the hose 72. And then the hose 72 is pulled out to discharge the overflowed oil, thereby solving the problem of obstruction of the pipe. This structure is simple and convenient to operate, and prevents the poor exhaust effect as a result of oil obstructed in the pipe, which improves the efficiency of the whole structure. The reset bracket 104 is configured to reset the hose 72 that has been deformed, which improves the strength of the hose 72 and avoids the obstruction of the pipe as a result of the hose 72 being deformed. The free end of the rotating arm 71 can be limited by the positioning groove 103. In daily use, the rotating arm 71 can be prevented from abutting on the hose 72, and the rotating arm can protect the hose 72 through the positioning groove 103, so as to prevent the hose 72 from being damaged by external forces and improve the service life of the product.

As shown in FIG. 1, the stirring paddle includes the stirring shaft 51. One end of the stirring shaft 51 is connected to the stirring motor 5, and the other end of the stirring shaft 51 extends into the stirring cavity. The connecting rods 52 are arranged at intervals along the height direction on the stirring shaft 51, and the projections of the connecting rods 52 adjacent to each other on the bottom surface of the stirring cavity are perpendicular. The ends of the connecting rods 52 adjacent to each other are connected to the blade 53, and the blades 53 are connected to each other to form a double helical stirring blade. The advantages of this arrangement are as follows: in the above solution, the structure of the stirring paddle can better stir the slurry with high consistency and improve the efficiency of the product.

As shown in FIG. 1, the slurry mixing tank 2 is provided with the water inlet, and the water inlet is connected to the stirring cavity. The water inlet pipe is arranged on the water inlet, and the diaphragm valve 25 and the flowmeter 29 are arranged between the water inlet pipe and the water inlet in turn. The advantages of this arrangement are as follows: in the above solution, it is convenient to control the water inflow, which improves the stirring effect.

As shown in FIG. 3, the jacket 31 is formed on the outer wall of the slurry feeding tank 3, and the water injection cavity is formed in the jacket 31. The water inlet pipe 35 is arranged on the jacket 31, and the water inlet pipe 35 is connected to the water injection cavity. The bottom surface of the jacket 31 is further provided with the water outlet pipe 36 connected to the water injection cavity. The advantages of this arrangement are as follows: in the above solution, it is convenient to cool the can by adding the water into the water injection cavity, which is simple in structure and easily constructed.

The shielding cover 93 is further arranged between the piston 91 and the output end of the driving cylinder 9. The locking groove is arranged on the edge of the shielding cover 93. The locking handle 33 for fixing the shielding cover 93 on the slurry feeding tank 3 is hinged on the outer wall of the slurry feeding tank 3. The width of the locking handle 33 is matched with the width of the locking groove. One end of the locking handle 33 is hinged to the outer wall of the slurry feeding tank 3, and the other end of the locking handle 33 is threaded to the positioning cap 34. The positioning cap 34 is rotated to abut on the shielding cover 93, so as to fixedly connect the shielding cover 93 to the slurry feeding tank 3. The advantages of this arrangement are as follows: in the above solution, the shielding cover 93 is configured to avoid the entry of external impurities in the slurry discharge process, thereby ensuring the cleanliness of the slurry. This structure is simple. Meanwhile, the fast locking and unlocking can be realized through the locking handle 33 arranged on the side wall of the slurry feeding tank 3, so as to improve the efficiency of the device.

As shown in FIG. 2, the rotating paddle includes the rotating shaft 83 and at least two rotating blades 84 connected to the rotating shaft 83. One end of the rotating shaft 83 is connected to the output end of the rotating motor 81, and the other end of the rotating shaft 83 is an extension end. The rotating blades 84 are L-shape. The transverse end of the rotating blade 84 is connected to the extension end of the rotating shaft 83. The rotating shaft 83 is further provided with the temperature measurement probe 85 for measuring the temperature. The advantages of this arrangement are as follows: in the above solution, the rotating blades 84 are designed to be L-shaped, which can fully stir the slurry and improve the stirring efficiency and the cooling effect. Meanwhile, the temperature measurement probe 85 can read the temperature measured in time and determine the degree of cooling.

The above embodiment is only a preferred embodiment of the present invention and cannot be construed to limit the protective scope of the present invention. Therefore, the equivalent changes made according to the scope of protection of the present invention, for example, equivalent products with similar processes and similar structures shall fall within the scope of protection of the present invention.

What is claimed is:

1. A slurry mixing device, comprising an installation frame, a slurry mixing tank, a slurry feeding tank, a cooling mechanism and a slurry discharging mechanism, wherein, the slurry mixing tank, the cooling mechanism and the slurry discharging mechanism are successively arranged on the installation frame; the installation frame is provided with a transport channel under the slurry mixing tank, the cooling mechanism and the slurry discharging mechanism; the slurry feeding tank is provided with an open end and is movably arranged in the transport channel along a direction of the transport channel; the transport channel is provided with a mass scale at a position corresponding to the slurry mixing tank;

a stirring cavity is formed in the slurry mixing tank, and a stirring paddle is rotatably arranged in the stirring cavity; a stirring motor for rotatably driving the stirring paddle is arranged on the slurry mixing tank; a bottom of the stirring cavity extends to an outside of the slurry mixing tank to form an outlet; an oil bath cavity is formed between the slurry mixing tank and the stirring cavity;

the cooling mechanism comprises a lifting cylinder and a lifting base, wherein the lifting base is provided with a rotating paddle and a rotating motor for rotatably driving the rotating paddle; the lifting cylinder is arranged on the installation frame; an output end of the lifting cylinder is arranged along a height direction of the installation frame, and the output end of the lifting cylinder is connected to the lifting base to cause the rotating paddle to enter the slurry feeding tank and to perform a cooling operation; and the slurry discharging mechanism comprises a piston and a driving cylinder, wherein, the driving cylinder is configured to drive the piston to enter the slurry feeding tank to extrude and discharge a slurry; an output end of the driving cylinder is arranged along the height direction of the installation frame, and the piston is connected to the output end of the driving cylinder; the piston is provided circumferentially with an elastic sealing ring for an interference fit with the slurry feeding tank after the piston enters the slurry feeding tank; and a slurry outlet is arranged at a bottom of the slurry feeding tank.

2. The slurry mixing device according to claim 1, wherein, an electric heating pipe is arranged in the oil bath cavity; an oil outlet is arranged on a bottom surface of the oil bath cavity, and an oil inlet is arranged on a side wall of the slurry mixing tank; the oil inlet is connected to the oil bath cavity, and the oil inlet is provided with an oil feeding mechanism for transporting an oil into the oil bath cavity; an inspection window is further arranged on the side wall of the slurry mixing tank; the inspection window is arranged under the oil feeding mechanism and is connected to the oil bath cavity; and the inspection window is provided with an oil level sight glass.

3. The slurry mixing device according to claim 2, wherein, the oil feeding mechanism comprises a T-shaped three-way pipe, and the T-shaped three-way pipe comprises a main pipe, a first pipe and a second pipe, wherein the first pipe and the second pipe are arranged on both sides of the main pipe; the main pipe is connected to the oil inlet; a first end of the first pipe is connected to the main pipe, and a second end of the first pipe is connected to an oil feeding funnel; a first end of the second pipe is connected to the main pipe, and a second end of the second pipe is connected to a smoke exhaust assembly; and the main pipe is provided with a three-way ball valve connected to the first pipe or the second pipe.

4. The slurry mixing device according to claim 3, wherein, the smoke exhaust assembly comprises a respirator and an oil collecting bottle; an upper end of the respirator is provided with a smoke outlet, and a lower end of the respirator is provided with a connection port and connected to the second pipe; the oil collecting bottle is arranged on one side of the connection port, and the oil collecting bottle is connected to the respirator through a conduit.

5. The slurry mixing device according to claim 3, wherein, a hose is arranged between the second pipe and the three-way ball valve; a clamping head is arranged on an outer wall of the second pipe and comprises a rotating base and a plurality of rotating arms; the rotating base is threaded to the outer wall of the second pipe; a first end of the rotating arm is hinged on the rotating base, and a second end of the rotating arm is a free end; the free end of the rotating arm abuts on an outer wall of the hose to press the hose; an inner wall of the hose is provided with a reset bracket; the reset bracket is configured to reset the hose after the hose is pressed; a positioning groove is provided at a connection position of the three-way ball valve and the second pipe, and the free end of the rotating arm is inserted into the positioning groove to fix the clamping head.

6. The slurry mixing device according to claim 1, wherein, the stirring paddle comprises a stirring shaft; a first end of the stirring shaft is connected to the stirring motor, and a second end of the stirring shaft extends into the stirring cavity; connecting rods are arranged at intervals along a height direction on the stirring shaft; ends of the connecting rods adjacent to each other are connected to a blade, and the blades are connected to each other to form a double helical stirring blade.

7. The slurry mixing device according to claim 1, wherein, a jacket is formed on an outer wall of the slurry feeding tank, and a water injection cavity is formed in the jacket; a water inlet pipe is arranged on the jacket, and the water inlet pipe is connected to the water injection cavity;

and a bottom surface of the jacket is further provided with a water outlet pipe connected to the water injection cavity.

8. The slurry mixing device according to claim 1, wherein, a shielding cover is arranged between the piston and the output end of the driving cylinder; a locking groove is arranged on an edge of the shielding cover; a locking handle for fixing the shielding cover on the slurry feeding tank is hingedly connected to the outer wall of the slurry feeding tank; a width of the locking handle is matched with a width of the locking groove; a first end of the locking handle is hingedly connected to the outer wall of the slurry feeding tank, and a second end of the locking handle is threaded to the positioning cap; and the positioning cap is rotated to abut on the shielding cover so as to fixedly connect the shielding cover to the slurry feeding tank.

9. The slurry mixing device according to claim 1, wherein, the rotating paddle comprises a rotating shaft and at least two rotating blades connected to the rotating shaft; a first end of the rotating shaft is connected to an output end of the rotating motor, and a second end of the rotating shaft is an extension end; the at least two rotating blades are L-shape; a transverse end of each of the at least two rotating blades is connected to the extension end of the rotating shaft; and the rotating shaft is provided with a temperature measurement probe for measuring temperature.

10. The slurry mixing device according to claim 2, wherein, the stirring paddle comprises a stirring shaft; a first end of the stirring shaft is connected to the stirring motor, and a second end of the stirring shaft extends into the stirring cavity; connecting rods are arranged at intervals along a height direction on the stirring shaft; ends of the connecting rods adjacent to each other are connected to a blade, and the blades are connected to each other to form a double helical stirring blade.

11. The slurry mixing device according to claim 3, wherein, the stirring paddle comprises a stirring shaft; a first end of the stirring shaft is connected to the stirring motor, and a second end of the stirring shaft extends into the stirring cavity; connecting rods are arranged at intervals along a height direction on the stirring shaft; ends of the connecting rods adjacent to each other are connected to a blade, and the blades are connected to each other to form a double helical stirring blade.

12. The slurry mixing device according to claim 4, wherein, the stirring paddle comprises a stirring shaft; a first end of the stirring shaft is connected to the stirring motor, and a second end of the stirring shaft extends into the stirring cavity; connecting rods are arranged at intervals along a height direction on the stirring shaft; ends of the connecting rods adjacent to each other are connected to a blade, and the blades are connected to each other to form a double helical stirring blade.

13. The slurry mixing device according to claim 5, wherein, the stirring paddle comprises a stirring shaft; a first end of the stirring shaft is connected to the stirring motor, and a second end of the stirring shaft extends into the stirring cavity; connecting rods are arranged at intervals along a height direction on the stirring shaft; ends of the connecting rods adjacent to each other are connected to a blade, and the blades are connected to each other to form a double helical stirring blade.

14. The slurry mixing device according to claim 7, wherein, a shielding cover is arranged between the piston and the output end of the driving cylinder; a locking groove is arranged on an edge of the shielding cover; a locking handle for fixing the shielding cover on the slurry feeding tank is hingedly connected to the outer wall of the slurry feeding tank; a width of the locking handle is matched with a width of the locking groove; a first end of the locking handle is hingedly connected to the outer wall of the slurry feeding tank, and a second end of the locking handle is threaded to the positioning cap; and the positioning cap is rotated to abut on the shielding cover so as to fixedly connect the shielding cover to the slurry feeding tank.

* * * * *